US009346569B2

(12) United States Patent
Ford et al.

(10) Patent No.: US 9,346,569 B2
(45) Date of Patent: May 24, 2016

(54) PROCESS AND APPARATUS FOR PRODUCING PACKETS

(75) Inventors: Thomas David Reid Ford, Royston (GB); James Robert Stirling Howarth, Cambridge (GB); Adrian Michael Woodward, Bury St Edmonds (GB)

(73) Assignee: Conopco, Inc., Englewood Cliffs, NJ (US)

( * ) Notice: Subject to any disclaimer, the term of this patent is extended or adjusted under 35 U.S.C. 154(b) by 642 days.

(21) Appl. No.: 13/805,001

(22) PCT Filed: Jun. 29, 2011

(86) PCT No.: PCT/EP2011/060880

§ 371 (c)(1),
(2), (4) Date: Feb. 14, 2013

(87) PCT Pub. No.: WO2012/004169

PCT Pub. Date: Jan. 12, 2012

(65) Prior Publication Data

US 2013/0133292 A1 May 30, 2013

(30) Foreign Application Priority Data

Jul. 7, 2010 (EP) ..... 10168701

(51) Int. Cl.
*B65B 7/00* (2006.01)
*B65B 9/04* (2006.01)
(Continued)

(52) U.S. Cl.
CPC . *B65B 7/00* (2013.01); *B65B 9/042* (2013.01); *B65B 29/02* (2013.01); *B65B 61/08* (2013.01); *B65B 51/225* (2013.01); *B65D 75/50* (2013.01);
(Continued)

(58) Field of Classification Search
CPC ..... B65B 7/00
USPC ..... 53/413, 134.2; 493/253, 254
See application file for complete search history.

(56) References Cited

U.S. PATENT DOCUMENTS 1,489,806 A * 4/1924 Anderson ..... 426/77
1,581,578 A * 4/1926 Kieselbach ..... 426/77
(Continued)

FOREIGN PATENT DOCUMENTS

EP 0943544 9/1999
EP 2119638 A1 11/2009
(Continued)

OTHER PUBLICATIONS

International Search Report, PCT/EP2011/060880, mailed Jan. 2, 2012, 3 pp.
(Continued)

*Primary Examiner* — Hemant M Desai
*Assistant Examiner* — Mobeen Ahmed
(74) *Attorney, Agent, or Firm* — Ellen Plotkin

(57) ABSTRACT

A process for sequentially forming a plurality of enclosed containers (32) comprising a product, the process involving passing a continuous web (10), comprising a strip of container material having two opposing edges (4, 6), to a folding station (12), whereupon each open container is sequentially formed by folding the web, to bring into contact two contiguous edge portions (9*a*, 9*b*) from only one edge of the web, then sealing the two edges together to form a portion of the web into an open container, depositing the product onto the web so that it is held within the open containers, and then sealing the open containers to form the enclosed containers.

16 Claims, 6 Drawing Sheets

(51) Int. Cl.

| | |
|---|---|
| ***B65B 29/02*** | (2006.01) |
| ***B65B 61/08*** | (2006.01) |
| *B65D 81/00* | (2006.01) |
| *B65D 85/808* | (2006.01) |
| *B65D 75/50* | (2006.01) |
| *B65D 85/00* | (2006.01) |
| *B65B 51/22* | (2006.01) |

(52) U.S. Cl.

CPC ..... *B65D 85/542* (2013.01); *B65D 85/808* (2013.01); *B65D 2081/002* (2013.01)

(56) References Cited

U.S. PATENT DOCUMENTS

| | | | | | |
|---|---|---|---|---|---|
| 3,090,175 | A | | 5/1963 | Berglund | |
| 3,597,222 | A | * | 8/1971 | Kalemba | 426/79 |
| 3,925,959 | A | * | 12/1975 | Dykes et al. | 53/451 |
| 4,064,662 | A | * | 12/1977 | O'Toole | 52/71 |
| 4,081,305 | A | * | 3/1978 | Patin | 156/204 |
| 4,216,639 | A | * | 8/1980 | Gautier | 53/413 |
| 4,290,521 | A | * | 9/1981 | Mitchell | 206/0.5 |
| 4,551,336 | A | * | 11/1985 | Chen | 426/83 |
| 5,548,947 | A | * | 8/1996 | Fincham et al. | 53/551 |
| 6,274,180 | B1 | * | 8/2001 | Ryan et al. | 426/82 |
| 6,571,537 | B2 | | 6/2003 | Ghirlandi | |
| 7,371,297 | B2 | * | 5/2008 | Caroli | 156/64 |
| 7,546,721 | B2 | * | 6/2009 | Rasile et al. | 53/450 |
| 2003/0131565 | A1 | * | 7/2003 | Romagnoli | 53/413 |
| 2004/0261370 | A1 | * | 12/2004 | Rea et al. | 53/455 |
| 2006/0042758 | A1 | | 3/2006 | Caroli | |
| 2008/0299262 | A1 | * | 12/2008 | Reati | 426/84 |
| 2011/0047937 | A1 | * | 3/2011 | Tsuji et al. | 53/413 |

FOREIGN PATENT DOCUMENTS

| | | |
|---|---|---|
| GB | 2408252 | 11/2004 |
| JP | 2003086233 | 3/2003 |
| JP | 2008143528 | 6/2008 |
| JP | 2010143601 | 7/2010 |
| WO | WO9501907 | 1/1995 |
| WO | WO2004033303 | 4/2004 |
| WO | WO2005047111 | 5/2005 |
| WO | WO2005051797 | 6/2005 |
| WO | WO2006027665 | 3/2006 |
| WO | WO2009141871 | 11/2009 |

OTHER PUBLICATIONS

Search Report in EP10168701, Oct. 26, 2010.

* cited by examiner

PROCESS AND APPARATUS FOR PRODUCING PACKETS

TECHNICAL FIELD OF THE INVENTION

The present invention relates to the manufacture of packets, in particular to infusion packets such as tea bags having a pre-determined three-dimensional shape.

BACKGROUND TO THE INVENTION

For many years infusion packets, such as tea bags, were available primarily as square or round two-ply sheets of porous filter material with the infusible material, such as tea, sandwiched between the sheets. Such packets restrict the flow of infusible material within the packet substantially to two dimensions. As a result the infusion performance of such packets is limited.

Thus the past few decades have seen the development of mass-produced infusion packets which have a more three-dimensional shape and which allow the infusible substance more room to move. Of particular success have been the tetrahedral-shaped packets such as those described in the international patent applications published as WO 95/01907 (Unilever) and WO 2004/033303 (I.M.A. SPA).

In the manufacture of tetrahedral packets, the tetrahedral shape is conventionally formed by making mutually perpendicular transverse seals in a tube of filter material and apparatus designed for such manufacture is ill-suited to the manufacture of other three-dimensional shapes. Furthermore, although filling of the infusible material into the tubular packets at the high rates required for commercial mass-production is possible for readily-flowable and robust material such as finely-cut tea, delicate and/or sticky materials (such as large-leaf teas, fruit pieces and the like) often become damaged at the high dosing speeds.

It would, of course, be possible to operate at slower dosing speeds and yet produce tetrahedral infusion packages at high rates if several production lines were run in parallel but this would necessarily increase the cost and size of the manufacturing facilities required.

A process which is capable of producing such packets at a high speed without damaging such delicate materials would therefore be highly desirable.

DEFINITIONS

Where a material is said to be "gathered" about a forming member to form a three-dimensional shape, it is meant that the material is drawn about the forming member to form the three-dimensional shape without causing substantial deformation of the material.

It should be noted that in specifying any range of concentration or amount, any particular upper concentration can be associated with any particular lower concentration or amount.

For the avoidance of doubt, the word "comprising" is intended to mean "including" but not necessarily "consisting of" or "composed of". In other words, the listed steps or options need not be exhaustive.

The disclosure of the invention as found herein is to be considered to cover all embodiments as found in the claims as being multiply dependent upon each other irrespective of the fact that claims may be found without multiple dependency or redundancy.

SUMMARY OF THE INVENTION

In a first aspect, the invention relates to a process for sequentially forming a plurality of enclosed containers comprising a product, the process involving passing a continuous web, comprising a strip of container material having two opposing edges, to a folding station, whereupon each open container is sequentially formed by folding the web, to bring into contact two contiguous edge portions from only one edge of the web, then sealing the two edges together to form a portion of the web into an open container, depositing the product onto the web so that it is held within the open containers, and then sealing the open containers to form the enclosed containers.

In a second aspect, the invention relates to an apparatus for sequentially forming a plurality of enclosed containers comprising a product, the apparatus comprising a folding station and a means for feeding a continuous web of container material having two opposing edges to the folding station, wherein the folding station comprises a folding means being arranged to form a respective open container by folding the web to bring together into contact two contiguous edge portions from only one edge of the web, the apparatus further comprising an edge sealing means arranged to seal the two edges together, thereby to sequentially form open containers, the apparatus further comprising a product deposition means and an open container sealing means, operable to sequentially form enclosed containers from the open containers.

Thus, the invention involves forming an open container by folding only one edge of the web back onto itself, bringing two contiguous edge portions together, which creates a three-dimensional open container in the web. Furthermore, a plurality of such containers can be produced in a continuous manner, producing a sequence of open containers from the web. The product dosing is also decoupled from the open container forming stage. This allows dosing to be carried by more than one doser, allowing each doser the time to dose potentially fragile product without compromising production speed.

It is important that each open container is formed by folding and bringing together two contiguous edge portions from only one side of the web. This results in the generation of an essentially three-dimensional open container. If folding of the web involved bringing together two pairs of contiguous edge portions from both sides of the web this would result in an essentially two-dimensional open container. Thus, by only folding back along one edge an open container is formed which is naturally three-dimensional, making dosing of the product easier and a more truly three-dimensional resulting container.

It is important to note that the edge which is folded to form a respective open container does not need to be the same edge as for all the containers. In fact, in one preferred embodiment, the edge which is folded alternates from one container to the next.

It can therefore be seen that a first edge may be folded back to form a first open container and then the second edge can be folded back to form a second open container. This can be followed by the first edge being folded back to form a third open container, and so forth.

It has been found that such a processing method lends itself particularly well to generating tetrahedral containers, albeit with one face missing. This shape is an ideal open container, and once filled with product, can be sealed appropriately to form a tetrahedral enclosed container comprising the product.

The folding of the web is greatly facilitated by the web comprising pre-folds at regions of the web when folding is to follow. Pre-folds can be introduced by pressing onto the web at appropriate locations, although many other methods will be known to the person skilled in the art.

Folding is typically carried out by grippers arranged to grip the web at discrete locations on both of its edges. Once gripped, the grippers are arranged to move towards each other, thus compelling the gripped web to yield under compression. If the movement of the grippers is suitably arranged, the web will yield by folding along an edge of the web.

It has been found that the desired folding response due to the grippers moving together is greatly facilitated if rigid forming members are employed which act to gather the web to fold in the desired manner.

Once folded, the contiguous edges are brought together and sealed together by any suitable means in the art. A preferred method is ultrasonic sealing, although other methods may also be appropriate.

The container material of the web may be made from any foldable material suitable for use in the intended application. Whilst such a material could be rigid and comprising pre-folds, it is preferable that the container material is flexible. In particular, it is preferable that the material is so flexible that it can fold onto itself without requiring a pre-fold.

As discussed above, the present invention is particularly suitable for the manufacture of infusible beverages, such as tea-based products, thus, preferably the container material is water-permeable, allowing water to pass freely through the material. Additionally it is also preferable that the container material be stable in water at 100° C. In particular it should not melt or dissolve in water at this temperature.

The edges of the web may be straight or undulating. However straight edges are preferred for simplicity.

The width of the web can be selected to suit the intended size of the containers formed by the process. However, for beverage applications, a width of from 2 to 10 cm is appropriate.

Thus, the product is preferably a particulate product, typically comprising infusible entities such as tea leaves. The product may also comprise other particulate entities such as fruit pieces or large leaf material which is more prone to breakage than conventional ground leaf tea.

Thus, it is another advantage of the invention that dosing of product can occur over a longer timescale without compromising production speed. This can be achieved by providing more than one doser, so that each doser does not need to dose into each and every open container. The open three-dimensional structure of the open containers facilitates simple dosing by simply depositing the product onto the web.

Dosing of product can be carried out either before or after formation of the open containers. If the container material includes pre-folds then it is possible to know beforehand when to deposit the product before formation of the open container so that it remains contained following formation.

However, it is preferable to dose the product into the open containers after they have been formed. Thus, preferably the open containers travel on to a dosing station after they have been formed.

The dosing station suitably comprises a plurality of dosing means, each arranged to dose into a fraction of the open containers, according to the number of dosers employed.

Thus, the process of the present invention is capable of a high throughput and can produce upwards of 500 containers per minute.

Sealing of the open containers can be carried out in a wide variety of ways. In one preferred embodiment, a second web of container material is brought into contact with the open containers and is cut and sealed over the opening. Another possibility is that a portion of the web, from which the open containers are formed, is employed to close the open container.

The invention will now be discussed by way of illustration and with reference to the following Figures, in which.

Figure 3A:
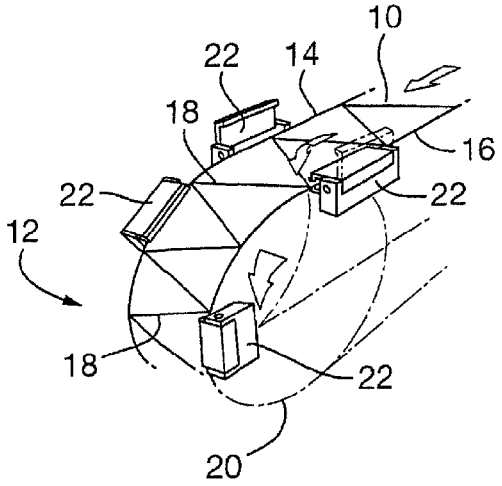
Figure 3B:
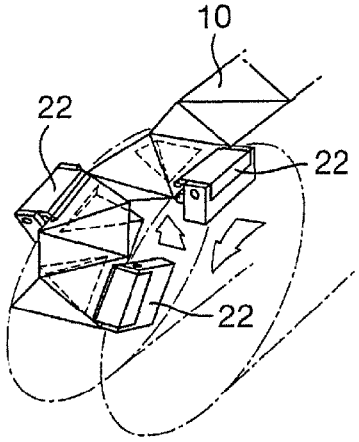
Figure 3C:
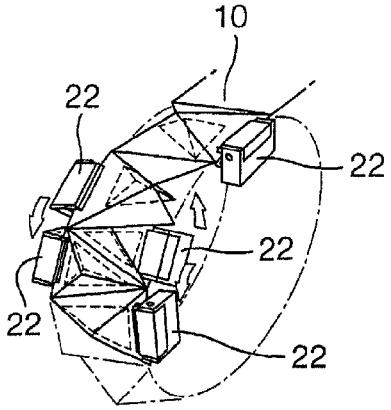

FIGS. 3*a* to 3*c* show perspective views of a folding station forming part of the process and apparatus according to the present invention.

Figure 4A:
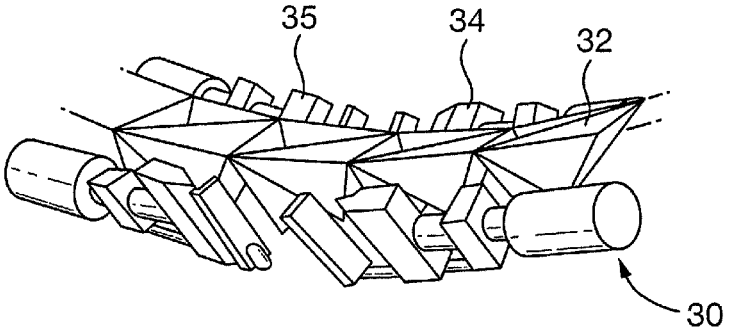
Figure 4B:
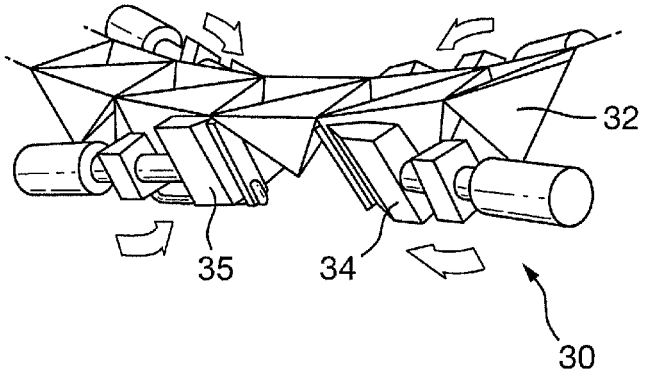

FIGS. 4*a* and 4*b* show perspective views of a sealing stage of the folding station shown in FIGS. 3*a* to 3*c*.

Figure 5A:
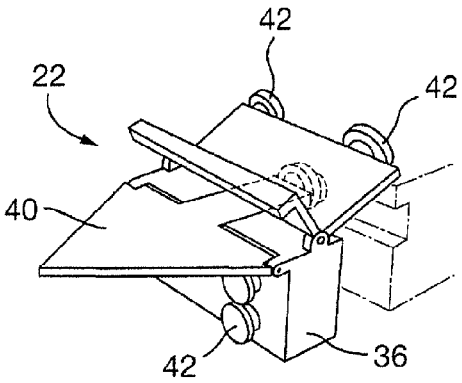
Figure 5B:
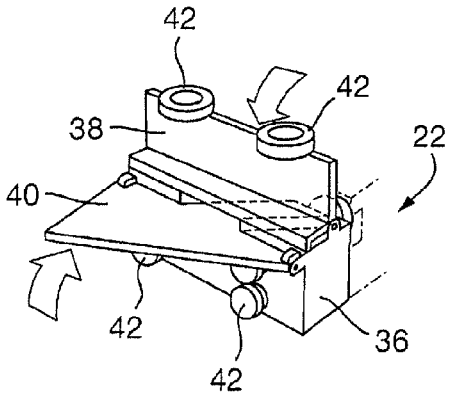

FIGS. 5*a* and 5*b* are perspective views of grippers employed in the folding station shown in FIGS. 3*a* to 3*c*.

Figure 6:
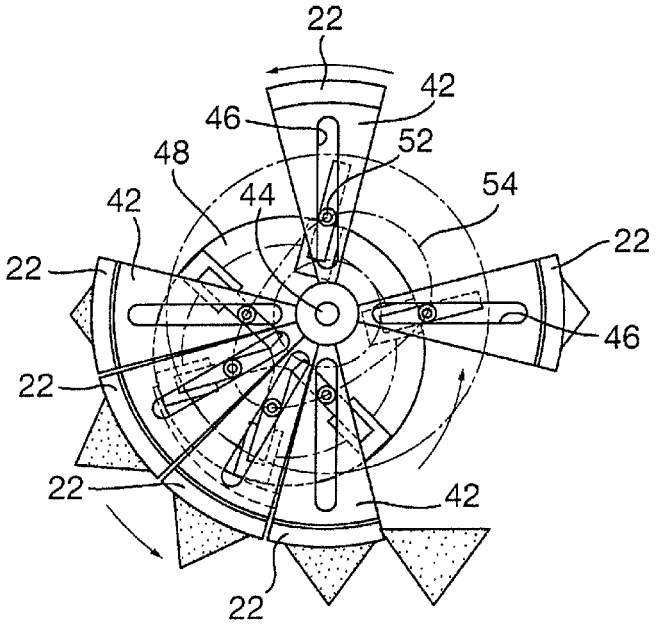

FIG. 6 is a side view of the folding station shown in FIGS. 1*a* to 1*c*.

Figure 7:
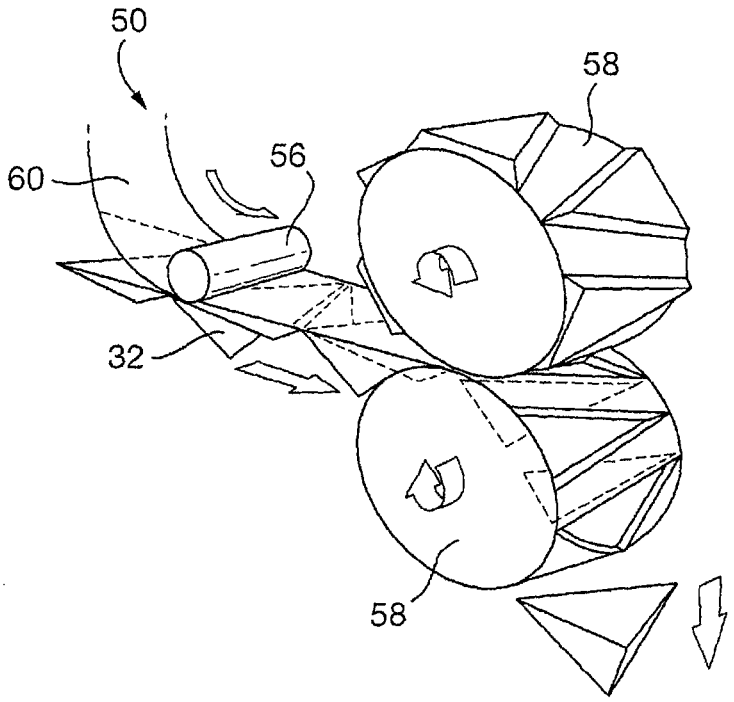

FIG. 7 is a perspective view of a sealing station forming part of the process and apparatus according to the invention.

Figure 1:
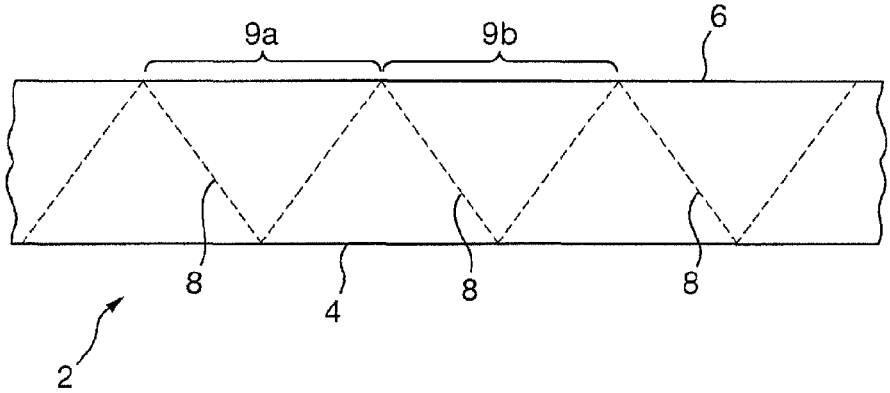
FIG. 1 is a schematic representation of a section of web of container material for use in the present invention.

Turning to the figures, FIG. 1 shows a portion of a continuous web 2 of container material. The web 2 comprises two parallel opposing edges 4,6 and a series of pre-folds 8. An open tetrahedral container is formed by bringing together and sealing the two contiguous edge portions 9*a*,9*b* from side 6. No folding along side 4 occurs for the open container shown.

Figure 2:
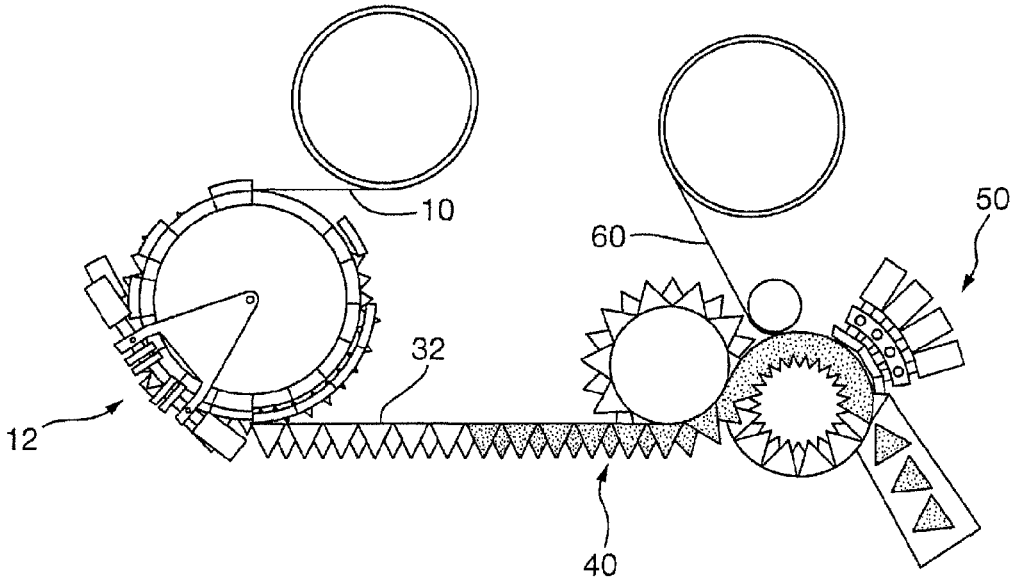
FIG. 2 is a side view of a process and apparatus according to the present invention.

FIG. 2 shows a side view of the entire process and apparatus, involving a continuous web of container material 10 travelling to a folding station 12 whereupon it travels to a dosing station 40 and then to a sealing station 50.

FIGS. 3*a* to 3*c* show a continuous web 10 of container material passing through a folding station 12.

The continuous web 10 is made of porous flexible paper, although other materials, such as nylon, may be employed. The web 10 has two parallel opposing edges 14,16 and has a number of pre-folds 18 within the container material.

The folding station 12 comprises a circular rotating conveyor 20 comprising moveable grippers 22, which are moveable relative to the rotating conveyor 20.

The continuous web 10 of container material is fed to the folding station 12 when it meets the rotating conveyor 20. It is then fed along the surface of the conveyor through the folding station 12. Grippers 22 are adapted to clamp the sides of the web 10 at particular locations in relation to the pre-folds 18.

As the web 10 travels through the folding station the grippers move relatively closer together, causing the web to experience compression. Each gripper 22 also comprises a former (not shown) which is shaped to fit the region bounded by the pre-folds, typically triangular. This former assists the folding of the web 10 along pre-folds and allows gathering of the web in response to the compression experienced.

As can be seen in FIGS. 3*b* and 3*c*, as the grippers 22 come closer together, contiguous edge portions from one side only, are brought together, thus forming an essentially three-dimensional open tetrahedral containers.

FIGS. 4*a* and 4*b* show in detail the latter stage of the folding station, which comprises an edge sealing stage 30. The sequence of tetrahedral shapes 32 travels through the edge sealing stage 30.

The sealing stage 30 comprises two pairs of actuating welders 34,35. As the sequence of open containers 30 passes through, the actuating welders 34,35 come together to ultrasonically seal together the contiguous edge portions brought into proximity by the folding station.

Thus, the sequence of tetrahedral shapes 32 leaves the edge sealing stage as a sequence of open tetrahedral containers.

FIGS. 5*a* and 5*b* show in greater detail the grippers 22 employed in the folding stage 12. The grippers 22 comprises a rigid body 36 having hingedly attached thereto a gripping portion 38. Also attached to rigid body 36 is a triangular former 40, which assists in the folding and gathering of the container material. The grippers are mounted on cam tracks (not shown) by means of bearings 42.

As the web 10 enters the folding stage, a gripper in the arrangement shown in FIG. 3*a* comes into contact with it. The arrangement is such that triangular former 40 rests beneath a portion of the web 10 so that pre-folds 10 extend just beyond the sides of former 40.

As the web 10 travels further through the folding station, the gripping portion 38 is forced to close onto the rigid body 36 by action of the cam track (not shown). This causes the web 10 to be gripped between gripping portion 38 and rigid body 36.

FIG. 6 shows parts of the folding station in greater detail. The figure is shown without the rotating conveyor 20 and with transparent elements, for clarity.

Each gripper 22 is mounted on a spoke 42 which are each rotatably attached to a hub 44. Each spoke 42 comprises a slot 46.

Also mounted is a drive wheel 48 rotatable about a central point, offset from hub 44. The drive wheel 48 comprises a number of bearings 52 arranged to be free to move radially with respect to the drive wheel and also connect with a slot 46 in a respective spoke 42.

By virtue of the offset between the centre of the drive wheel and the hub 44 and by virtue of the bearings 52 being only permitted to move radially with respect to the drive wheel, the bearings are compelled to travel along a non-circular path 54.

The non-circular path in turn induces rotation of the spokes 42 about their hub 44 with a fluctuating angular velocity. The arrangement is such that, at any moment in time, three or four spokes are grouped together around a fixed region of the folding station. Thus, relative motion between the grippers is induced in a regular manner, to facilitate continuous or semi-continuous processing.

Once the open tetrahedral containers have been prepared they pass to a dosing station where particulate product, eg. tea or other infusible beverage products, is deposited. More than one doser is provided, so that each doser deposits product into a fraction of the open containers.

The filled, but still open, tetrahedral containers then travel to a sealing station 50, as shown in FIG. 7.

The sealing station 50 comprises a roller 56 and two combined meld and cutter rollers 58.

The sequence of tetrahedral shapes 32 is brought into contact with a second web of container material 60. The sequence of tetrahedral shapes 32 and second web 60 are pressed into contact by passing under roller 56. The semi-sealed sequence then passes to weld and cutter rollers 58 when the second web 60 is welded to seal the containers and at the same time cuts the sequence into discrete filled sealed enclosed tetrahedral containers, at a speed in excess of 500 per minute.

The invention claimed is:

1. A process for sequentially forming a plurality of enclosed tetrahedral containers comprising a product, the process involving:

passing a continuous web, comprising a strip of container material having two opposing edges, to a folding station, whereupon each open container is sequentially formed by folding the web, to bring into contact two contiguous edge portions from only one edge of the web, then sealing the two edge portions together to form a portion of the web into an open container, wherein the open containers are tetrahedral containers, albeit with one face missing; wherein the edge which is folded alternates from one container to the next;

depositing the product onto the web so that it is held within the open containers, and then sealing the open containers to form the enclosed tetrahedral containers comprising the product.

2. An apparatus for sequentially forming a plurality of enclosed tetrahedral containers comprising a product, the apparatus comprising:

a folding station and a means for feeding a continuous web of container material having two opposing edges to the folding station, wherein the folding station comprises a means for folding the web being arranged to form a respective open container by folding the web to bring together into contact two contiguous edge portions from only one edge of the web, the apparatus further comprising a means for sealing an edge arranged to seal the two edge portions together, thereby to sequentially form open containers, wherein the open containers are tetrahedral containers, albeit with one face missing, the apparatus further comprising a means for depositing product and a means for sealing open container, operable to sequentially form enclosed tetrahedral containers comprising the product from the open containers.

3. A process according to claim 1, wherein the web comprises pre-folds at regions of the web when folding is to follow.

4. A process according to claim 1, wherein folding is carried out by grippers arranged to grip the web at discrete locations on both of its edges, the grippers being arranged to move towards each other, thus compelling the gripped web to yield under compression.

5. A process according to claim 1, wherein rigid forming members are employed which act to gather the web to fold.

6. A process according to claim 1, wherein the contiguous edges are brought together and sealed together by ultrasonic sealing.

7. A process according to claim 1, wherein the container material is flexible so that it can fold onto itself without requiring a pre-fold, at any point.

8. A process according to claim 1, wherein the container material is water-permeable, allowing water to pass freely through the material.

9. A process according to claim 1 wherein the container material is stable in water at 100° C.

10. A process according to claim 1, wherein the web has straight parallel edges.

11. A process according to claim 1, wherein the width of the web is from 2 to 10 cm.

12. A process according to claim 1, wherein the product is a particulate product comprising infusible entities such as tea leaves.

13. A process according to claim 12, wherein the product comprises other particulate entities which are more prone to breakage than conventional ground leaf tea.

14. A process according to claim 1, which comprises more than one doser.

15. A process according to claim 1, which is capable of producing upwards of 500 containers per minute.

16. A process according to claim 1, wherein a second web of container material is brought into contact with the open containers and is cut and sealed over the opening.

* * * * *